US010035257B2

(12) United States Patent
Darby et al.

(10) Patent No.: US 10,035,257 B2
(45) Date of Patent: Jul. 31, 2018

(54) PRECISION PIPE ETCHING MECHANISM

(71) Applicant: Nation Wide Products LLC, Abilene, TX (US)

(72) Inventors: Jason Darby, Abilene, TX (US); Jim Mann, Palestine, TX (US)

(73) Assignee: Nation Wide Products LLC, Abilene, TX (US)

( * ) Notice: Subject to any disclaimer, the term of this patent is extended or adjusted under 35 U.S.C. 154(b) by 302 days.

(21) Appl. No.: 15/085,693

(22) Filed: Mar. 30, 2016

(65) Prior Publication Data

US 2017/0282355 A1 Oct. 5, 2017

(51) Int. Cl.
*B25H 7/00* (2006.01)

(52) U.S. Cl.
CPC ..... *B25H 7/005* (2013.01)

(58) Field of Classification Search
CPC ..... B25H 7/005
USPC ..... 33/529, 562, 563
See application file for complete search history.

(56) References Cited

U.S. PATENT DOCUMENTS

D149,200 S * 4/1948 Martin ..... 33/563
2,813,343 A * 11/1957 Bruning ..... B25H 7/005 33/21.3
3,209,459 A * 10/1965 Fish, Jr. ..... B23D 51/025 33/529
3,381,385 A * 5/1968 Wilber ..... G01B 3/00 33/563
4,026,030 A * 5/1977 Kuever ..... B43L 13/205 33/464
4,094,071 A * 6/1978 Denaro ..... G01B 3/14 33/562
4,837,939 A * 6/1989 Pullen ..... B25H 1/0078 33/562
RE34,374 E * 9/1993 Davidson ..... B43L 7/14 144/144.51
6,077,000 A * 6/2000 Gibbons ..... B23B 47/28 33/529
6,195,904 B1 * 3/2001 Greer ..... B25H 7/02 33/494
6,944,964 B1 * 9/2005 Easter ..... G01B 3/14 33/528
6,986,210 B1 * 1/2006 Conway ..... E03C 1/33 33/452
7,134,218 B1 * 11/2006 Mitchell ..... G01B 3/14 33/529

(Continued)

*Primary Examiner* — Yaritza Guadalupe-McCall
(74) *Attorney, Agent, or Firm* — Norton Rose Fulbright US LLP

(57) ABSTRACT

An apparatus for marking pipes at a plurality of cutting angles comprises a marking plate of adjustable length. The marking plate comprises a plurality of apertures and a plurality indicators. Each aperture is of a different size and configured to receive a pipe of a certain diameter through the marking plate. Each aperture is defined by a first half-circle side and a second half-circle side and the distance between the first half-circle side and the second half-circle side of each aperture varies according to the adjusted length of the marking plate. Also, the distance between the first half-circle side and the second half-circle side of each aperture corresponds to an angle of a pipe received through the marking plate. Indicators specify a diameter of a pipe received through the adjustable marking plate and the angle of the pipe with respect to the adjustable marking plate.

20 Claims, 5 Drawing Sheets

(56) References Cited

U.S. PATENT DOCUMENTS

| | | | | |
|---|---|---|---|---|
| 7,210,241 | B1 * | 5/2007 | Bree | B25H 7/04 33/528 |
| 7,350,311 | B2 * | 4/2008 | Marks | B43L 13/20 33/1 B |
| 7,685,734 | B1 * | 3/2010 | Burger | B25H 7/005 33/1 G |
| 8,296,959 | B1 * | 10/2012 | Brooks | B25H 7/005 33/21.1 |
| 8,667,701 | B1 * | 3/2014 | Geesaman | A47B 97/00 33/474 |
| D795,717 | S * | 8/2017 | Darby | D10/64 |
| D798,750 | S * | 10/2017 | Darby | D10/64 |
| D798,751 | S * | 10/2017 | Darby | D10/64 |
| D799,347 | S * | 10/2017 | Darby | D10/64 |
| 2005/0217129 | A1 * | 10/2005 | Boys | H02G 3/00 33/528 |
| 2005/0246914 | A1 * | 11/2005 | Perea | B25D 5/00 33/562 |
| 2011/0030231 | A1 * | 2/2011 | Mueller | B43L 13/205 33/529 |
| 2014/0047725 | A1 * | 2/2014 | Taylor | B43L 13/20 33/529 |
| 2017/0282355 | A1 * | 10/2017 | Darby | B25H 7/005 |
| 2017/0355075 | A1 * | 12/2017 | Martin | B25H 7/005 |

* cited by examiner

PRECISION PIPE ETCHING MECHANISM

BACKGROUND

Pipe cutting is often necessary in different fabrication processes. For example, pipes of different diameters are often cut at various angles and then welded together to construct support frames for vehicles, dwellings, and the like. However, available pipe cutting mechanisms are unsatisfactory. Specifically, there is no way to notate the angle at which pipes of different diameters must be cut in a perceived and repeatable fashion.

SUMMARY

According to one aspect, an apparatus for marking pipes at a plurality of cutting angles comprises a marking plate of adjustable length. The marking plate comprises plurality of apertures and a plurality of indicators. Each of the plurality of apertures is of a size different from the size of each of the other of the plurality of apertures and is of a size to receive a pipe of a certain diameter through the adjustable marking plate. Also, each aperture is defined by a first half-circle side and a second half-circle side and the distance between the first half-circle side and the second half-circle side of each aperture varies according to the adjusted length of the marking plate. The distance between the first half-circle side and the second half-circle side of each aperture is adjusted in increments corresponding to an angle of a pipe received through the marking plate with respect to the surface of the marking plate when the pipe is abutted against the first half-circle end and the second half-circle end of the aperture through which it is received. Each of the plurality of indicators corresponds to a distance between a first half-circle end and a second-half circle end of the plurality of the apertures and specifies a diameter of a pipe received through the adjustable marking plate and the angle of the pipe with respect to the adjustable marking plate when the pipe of the specified diameter abuts the first end and the second end of the aperture at the corresponding distance between the first half-circle end and the second half-circle end of the aperture.

According to another aspect, an apparatus for marking pipes at a plurality of cutting angles comprises a marking plate. The marking plate comprises a plurality of apertures and a plurality of indicators. Each of the plurality of apertures is of a same width and of a different length and is of a size to receive a pipe of a specified diameter. Each aperture is defined by a first half-circle side and a second half-circle side and the distance between the first half-circle side and the second half-circle side of each aperture varies between each of the plurality of apertures. The distance between the first half-circle side and the second half-circle side of each aperture corresponds to an angle of the pipe of specified diameter received through the marking plate with respect to the surface of the marking plate when the pipe is abutted against the first half-circle end and the second half-circle end of the aperture through which it is received. Each of the plurality of indicators corresponds to an angle between the pipe of a specified diameter and the marking plate when the pipe of the specified diameter abuts the first end and the second end of the aperture.

BRIEF DESCRIPTION OF THE DRAWINGS

For a more complete understanding of the present invention, reference is now made to the following description taken in conjunction with the accompanying drawings, in which.

DETAILED DESCRIPTION

Figure 1A:
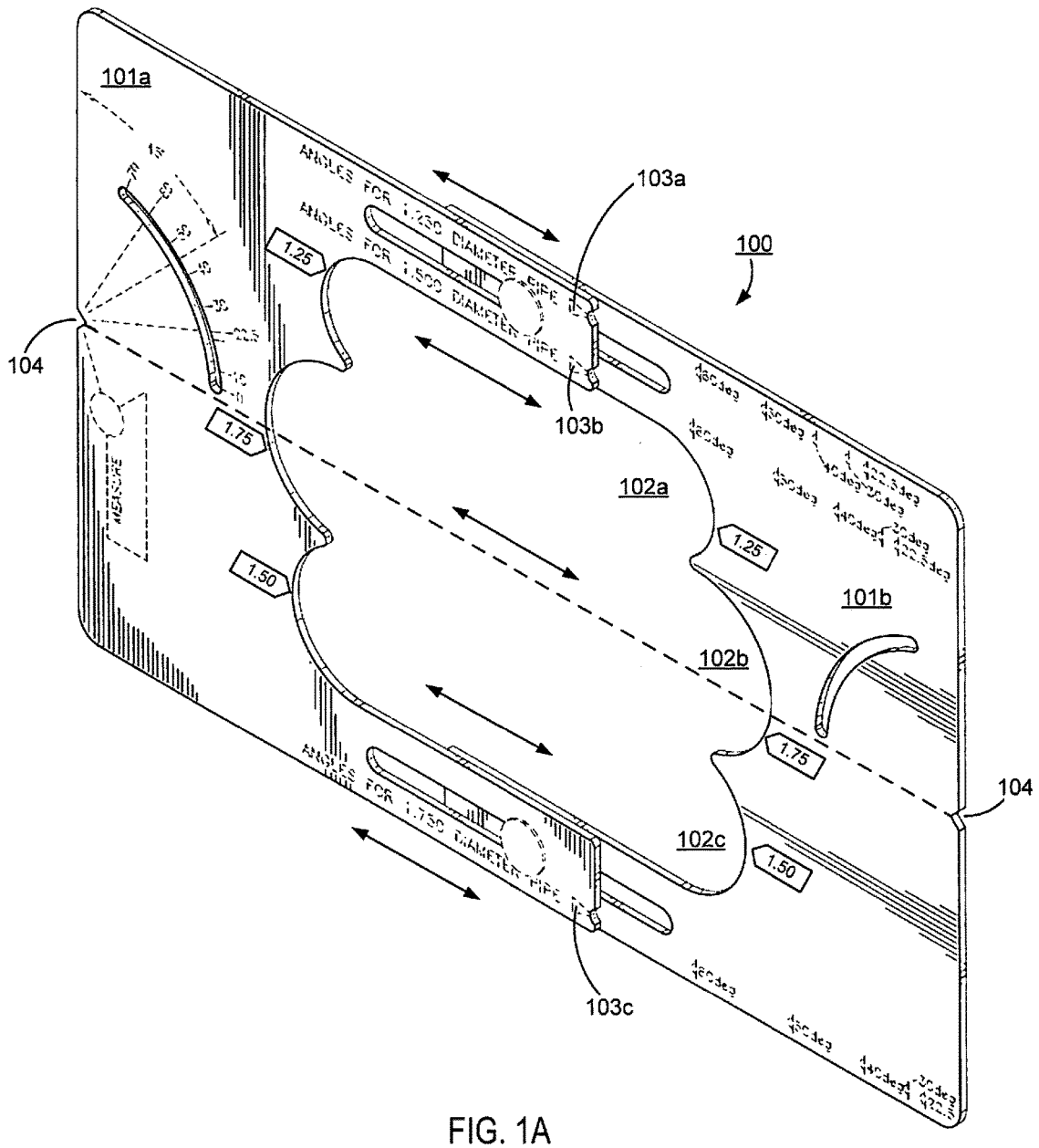
FIG. 1A illustrates aspects of a pipe etching system according to one embodiment.

Described embodiments provide a system for marking or etching pipes at different angles. Specifically, the marks or etches correspond to angles at which one or more pipes should be cut or bent. Referring to FIG. 1, marking plate 100 is illustrated. Marking plate 100 may comprise suitably rigid materials including, e.g., carbon steel or an equivalent. Further, marking plate 100 and its consistent components may be powder coated for added durability and resistance to corrosion.

Marking plate 100 is of adjustable length, as first plate 101*a* and second plate 101*b* can slide with respect to one another to adjust the effective length of marking plate 100. First plate 101*a* and second plate 101*b* can be secured or biased with respect to one another at a number of respective positions that provide different effective lengths for marking plate 100 by a number of mechanisms. According to one aspect, the length of marking plate 100 is fixed by locking the marking first plate 101*a* with respect to second plate 101*b*. First plate 101*a* can be locked in place with respect to second plate 101*b* by, e.g., a clamping means, or the like. According to an embodiment, first plate 101*a* and second plate 101*b* can be fixed with respect to one another by a fastening means, such as a bolt, that extends through respective apertures of first plate 101*a* and second plate 101*b* and a wing nut combination that is actuated along the length of the bolt until first plate 101*a* and second plate 101*b* are sufficiently biased against one another to hold them at a fixed position.

Sliding first plate 101*a* along the length of second plate 101*b* changes the effective length of marking plate 100, as the effective length of apertures 102*a*, 102*b*, 102*c*, . . . 102*n*, according to a certain embodiment of the invention. Different embodiments of marking plate 100 may comprise one or more apertures 102*a*-102*n*, where each is preferably of a different diameter in a closed position, i.e., where each aperture forms a circle or approximate circle.

According to the embodiment illustrated in FIG. 1, each of apertures 102*a*-102*c* are of different sizes, e.g., diameters, and are configured to receive a pipe through marking plate 100. According to the illustrated embodiment, aperture 102*a* is sized to accept a pipe having a diameter of 1.25 inches, aperture 102*b* is sized to accept a pipe having a diameter of 1.75 inches, and aperture 102*c* is sized to accept a pipe having a diameter of 1.50 inches. The sizes are marked by numerals stamped in marking plate 100, numerals affixed by an adhesive, and the like. Other embodiments could have apertures sized to accept pipes of different sizes. According to at least one embodiment, marking plate 100 includes apertures sized to accept pipes having a diameter of 1 inch as a minimum and a pipe having a diameter of 6 inches as a maximum. Other embodiments are envisioned where pipes of different sizes can be accepted at a corresponding aperture.

Each of apertures 102*a*-102*c* is defined by two sides of half-circle shape. Accordingly, when marking plate 100 is in its closed or retracted position, the two half-circle sides of each aperture 102*a*-102*c* are in contact with one another and are aligned to form a circle. In this case, each aperture 102*a*-102*c* can receive a pipe corresponding to the aperture's respective size at a 90 degree angle with respect to the surface of marking plate 100.

However, as marking plate 100 is adjusted to extend its effective length, the distance between the first half-circle side and the second half-circle side of each of apertures 102*a*-102*c* varies according to the adjusted length marking plate 100. As a result, a pipe received through any of apertures 102*a*-102*c* may be angled with respect to the surface of marking plate 100 when the pipe abuts the first half-circle end and the second half-circle end of the aperture through which it is received. As can be seen, the angle a pipe forms with respect to the surface of marking plate 100 when it abuts the first half-circle end and the second half-circle end of an aperture varies as the distance between the first half-circle end and the second half-circle end varies. As such, a user can manipulate the length of marking plate 100 to achieve a desired angle between the pipe and marking plate 100. Once the desired angle is achieved, as confirmed by using indicators 103, the user can score or otherwise mark the pipe to note the angle at which the pipe should be cut or bent. This, or course, greatly improves efficiency and repeatable accuracy in the field of pipe cutting and/or pipe bending.

Figure 1B:
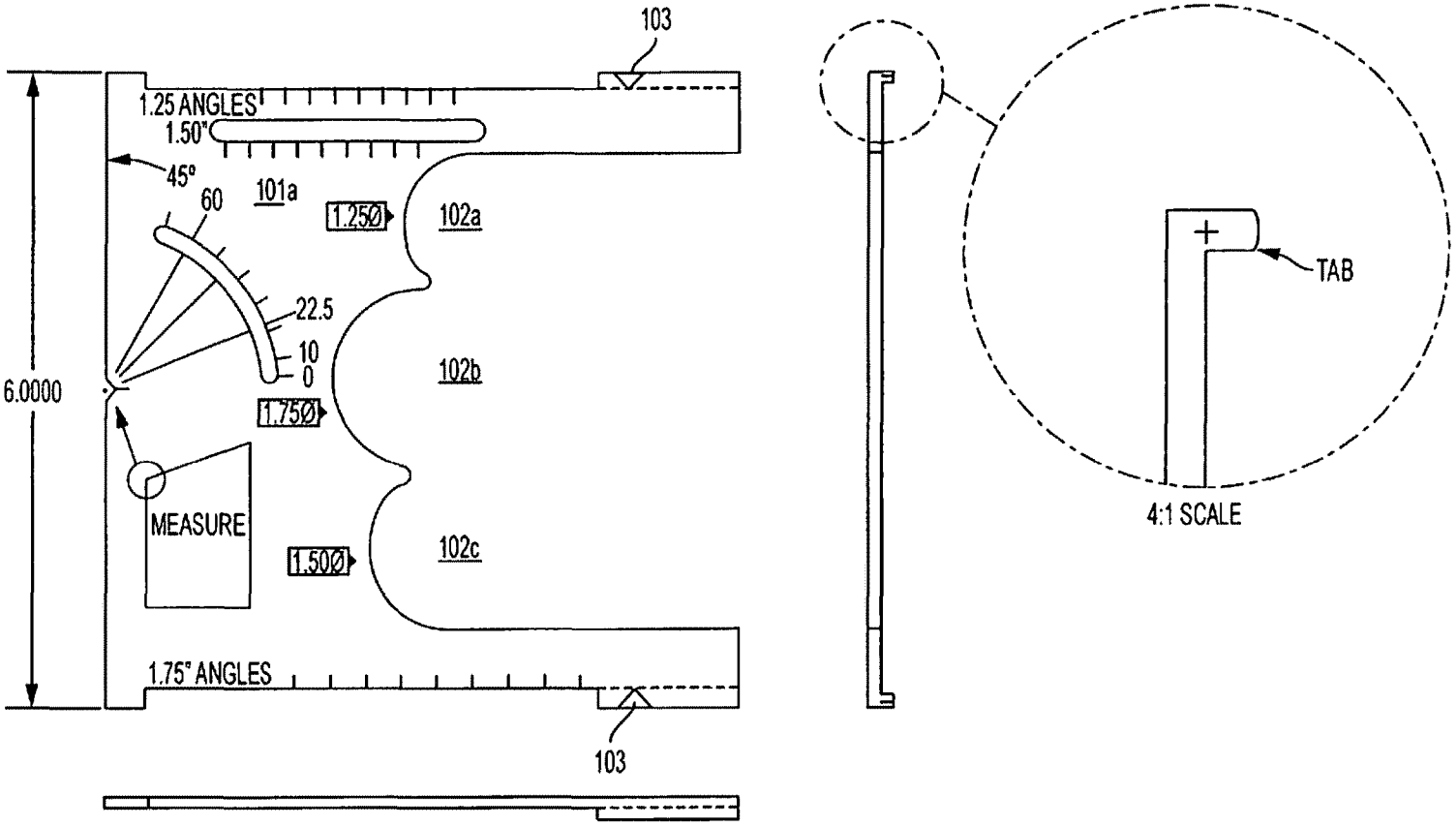
FIG. 1B illustrates aspects of a pipe etching system according to another embodiment.

According to one aspect, the length of marking plate 100 is adjusted incrementally to achieve specific angles thought to be most useful for pipes of a given diameter. Referring to FIG. 1B, this can be achieved by, e.g., sliding first plate 101*a* along the length of second plate 101*b*. According to this aspect, the distance between the first half-circle side and the second half-circle side of each aperture 102 is adjusted in increments corresponding to an angle of a pipe received through the marking plate with respect to the surface of the marking plate when the pipe is abutted against the first half-circle end and the second half-circle end of the aperture through which it is received. Marking plate 100 is also marked by various indicators 103. Indicators 103 give a user notice of what angle(s) a pipe forms with respect to marking plate 100 when received at a respective aperture 102. Each indicator 103 can be, e.g., silkscreened, stamped, etched, or laser cut into the surface of marking plate 100.

According to an aspect, each indicator 103*a*-103*n* corresponds to a distance between a first half-circle end and a second-half circle of each of apertures 102*a*-102*c*. Further, each indicator specifies, at each corresponding distance, the diameter of a pipe received through a given aperture 102*a*-102*c*, as well as the angle formed by the pipe of the given diameter at that specific distance. This may be pinpointed by aligning arrowheads marked on each of pieces 101*a* and 101*b*, such that the distance of marking plate 100 dictates the specific angle marked by indicator 103.

In other words, indicators 103 signify the angle between adjustable marking plate 100 and the pipe when the pipe of the specified diameter abuts the first end and the second end of the corresponding aperture 102, at the corresponding distance between the first half-circle end and the second half-circle end of the corresponding aperture 102.

According to an embodiment where marking plate 100 comprises two pieces that are movable with respect to one another, e.g., marking first plate 101*a* and second plate 101*b*, a user may slide marking first plate 101*a* along the length of second plate 101*b* to align an arrow head comprising a given indicator 103 for a pipe of a corresponding diameter forming a corresponding angle. Doing so signifies to the user when a pipe of a certain size forms a certain angle with respect to marking plate 100. Once the angle is formed, marking means 104 can be used to mark the pipe about a line at which it should be cut.

Marking means 104 can be used to mark a pipe received through adjustable marking plate 100 about a line at which the pipe should be cut when the pipe abuts the first half-circle end and the second half-circle end of an aperture 102. According to one aspect, making means 104 comprises a chalk line extending from a first end of marking plate 100 to a second end of marking plate 100. According to another aspect, marking means 104 comprises a sharp edge extending between each end of marking plate 100 and sufficient to score the pipe extending from a first end of marking plate 100 to a second end of marking plate 100.

Figure 2:
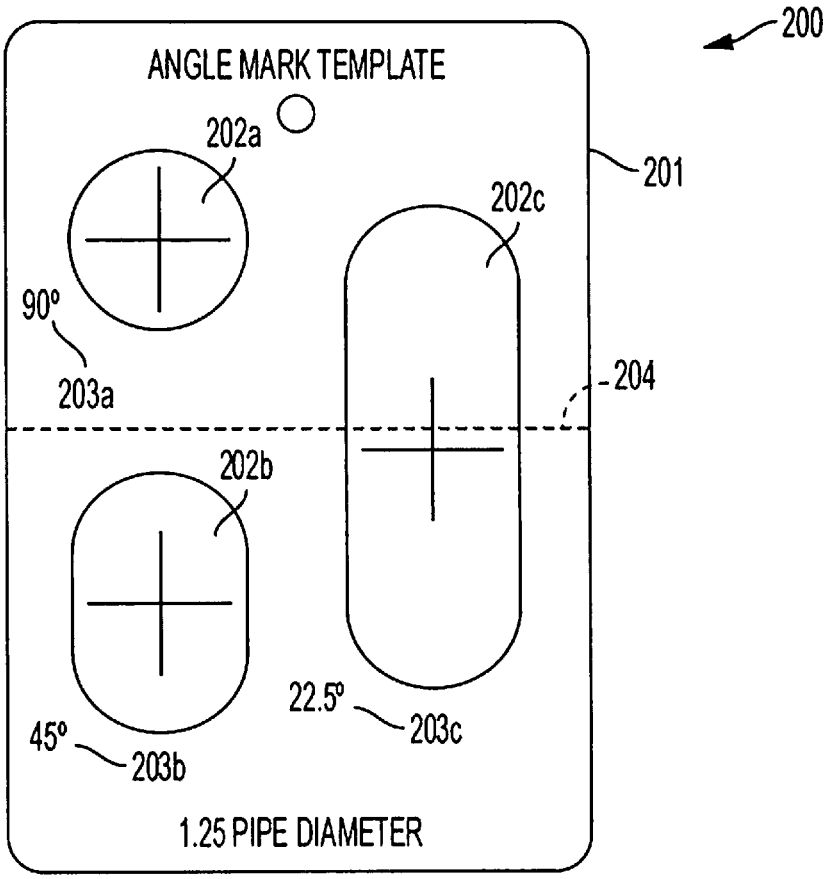
FIG. 2 illustrates aspects of a pipe etching system according to another embodiment.

FIG. 2 illustrates single-piece marking plate 200 for marking pipes at a plurality of cutting angles. According to the embodiment illustrated at FIG. 2, marking plate 201 comprises apertures 202*a*-202*c* and indicators 203*a*-203*c*.

Each of apertures 202*a*-202*c* shares the same width and are configured to receive a pipe of a specified diameter through marking plate 201. According to the illustrated embodiment, apertures 202*a*-202*c* are sized to accept a pipe having a diameter of 1.25 inches. Other embodiments could have apertures sized to accept pipes of different sizes. According to at least one embodiment, marking plate 201 includes apertures sized to accept pipes having a diameter of 1 inch as a minimum and a pipe having a diameter of 6 inches on as a maximum. Other embodiments are envisioned where pipes of different sizes can be accepted at a corresponding aperture.

Each of apertures 202*a*-202*c* is defined by two sides of half-circle shape. As seen, aperture 202*a* is configured such that the two half-circle sides are in contact with one another and are aligned to form a circle. In this case, each aperture 202*a* can receive a pipe corresponding to the aperture's respective size at a 90 degree angle with respect to the surface of marking plate 201.

However, according to apertures 202*b* and 202*c*, the distance between the first half-circle side and the second half-circle side varies. As a result, a pipe received through any of apertures 202*b* and 202*c* may be angled with respect to the surface of marking plate 201 when the pipe abuts the first half-circle end and the second half-circle end of the aperture through which it is received. As can be seen the angle a pipe forms with respect to the surface of marking plate 201 when it abuts first half-circle end and the second half-circle end of an aperture varies as the distance between the first half-circle end and the second half-circle end varies. As such, a user can manipulate the angle between the pipe of the specified diameter and the marking plate 201 by selecting to insert the pipe through one of apertures 202*a*-202*c*. This allows the user to achieve a desired angle between the pipe and marking plate 201. Once the desired angle is achieved, as confirmed by using indicators 203, the user can score or otherwise mark the pipe to note the angle at which the pipe should be cut.

Marking plate 201 is also marked by various indicators 203. Indicators 203 give a user notice of what angle a pipe forms with respect to marking plate 201 when received at one of apertures 202*a*-202*c*. Each indicator 203 can be, e.g., silkscreened, stamped, etched, or laser cut into the surface of marking plate 201.

According to an aspect, each indicator 203*a*-203*c* specifies, at each corresponding aperture 202*a*-202*c*, the angle formed by the pipe of the specified diameter with respect to marking plate 201, when the pipe abuts the first and second ends of the aperture. Indicators 203 correspond to an angle between the pipe of a specified diameter and the marking plate 201 when the pipe of the specified diameter abuts the first end and the second end of the aperture 202. In other words, indicators 203 signify the angle between adjustable marking plate 201 and the pipe, when the pipe of the specified diameter abuts the first end and the second end of the corresponding aperture 202.

Once the angle is noted marking means 204 can be used to mark the pipe about a line at which it should be cut. Marking means 204 can be used to mark a pipe received through marking plate 201 about a line at which the pipe should be cut when the pipe abuts the first half-circle end and the second half-circle end of an aperture 202. According to one aspect, making means 204 comprises a chalk line extending from a first end of marking plate 201 to a second end of marking plate 201. According to another aspect, marking means 204 comprises a sharp edge sufficient to score the pipe extending from a first end of marking plate 201 to a second end of marking plate 201.

Figure 3:
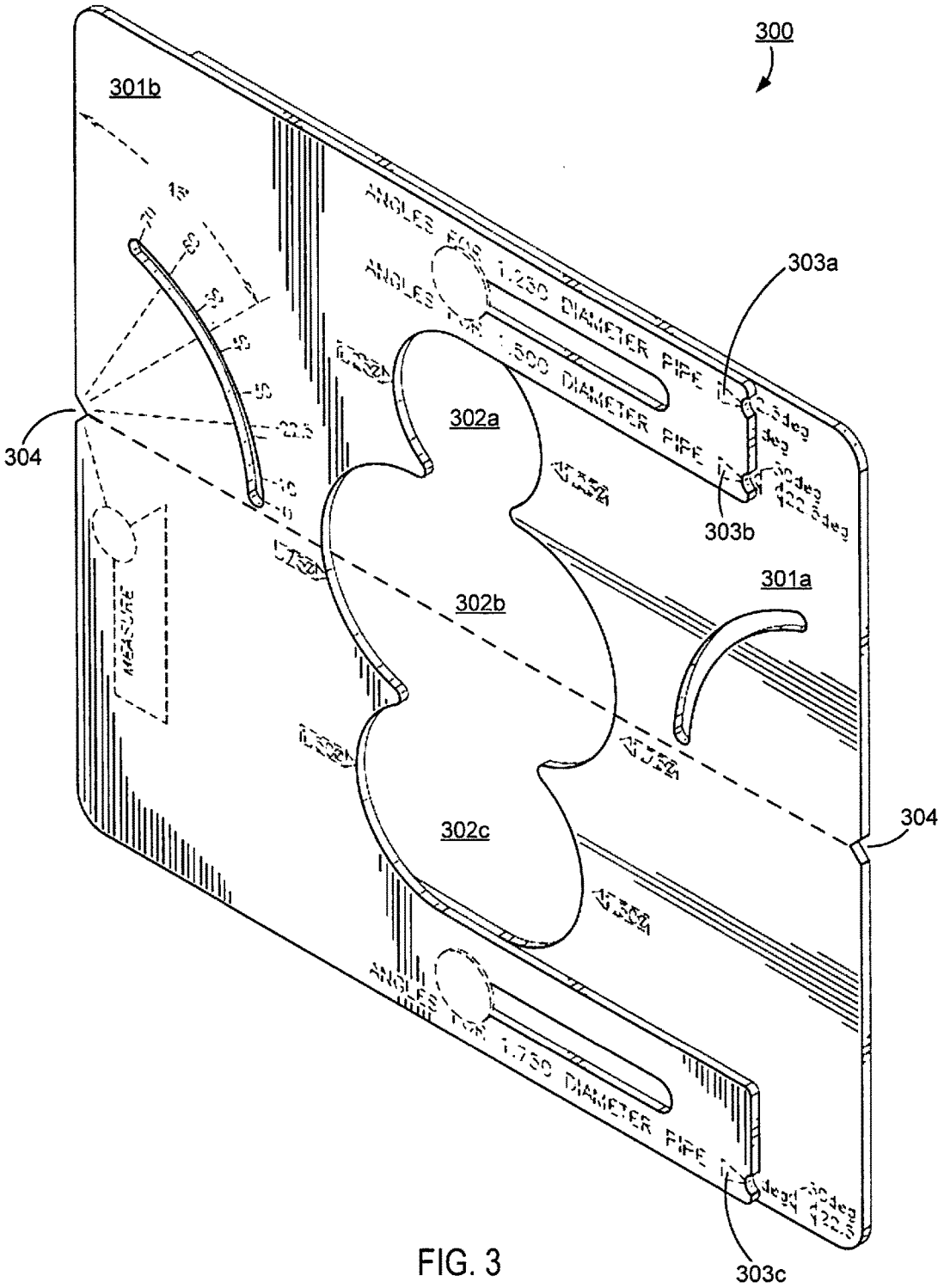
FIG. 3 illustrates aspects of a pipe etching system according to another embodiment.

FIG. 3 illustrates an embodiment of marking plate 300 in a closed position, but otherwise corresponds to marking plate 100 illustrated FIG. 1, which is illustrated in a semi-open position. Like the embodiment illustrated in FIG. 1, marking plate 300 is of adjustable length, as first plate 301*a* and second plate 301*b* can slide with respect to one another to adjust the effect length of marking plate 300. First plate 301*a* and second plate 301*b* can be secured or biased with respect to one another at a number of respective positions that provides different effective lengths for marking plate 300 by a number of mechanisms. According to one aspect, the length of marking plate 300 is fixed by locking the marking first plate 301*a* with respect to second plate 301*b*. Marking first plate 301*a* can be locked in place with respect to second plate 301*b* by, e.g., a clamping means, or the like. According to an embodiment, first plate 301*a* and second plate 301*b* can be secured to one another can be fixed with respect to one another by a fastening means, such as a bolt, that extends through respective apertures of first plate 301*a* and second plate 301*b* and a wing nut combination that is actuated along the length of the bolt until first plate 301*a* and second plate 301*b* are sufficiently biased against one another to hold them at a fixed position.

Sliding first plate 301*a* along the length of second plate 301*b* changes the effective length of marking plate 300, as the effective length of apertures 302*a*, 302*b*, 302*c*, . . . 302*n*, according to certain embodiment of the invention. Different embodiments of marking plate 300 may comprise one or more apertures 302*a*-302*n*, where each is preferably of a different diameter in a closed most position, i.e., where each aperture forms a circle or approximate circle.

According to the embodiment illustrated in FIGURE d, each of apertures 302*a*-302*c* are of different sizes, e.g., diameters, and are configured to receive a pipe through marking plate 300. According to the illustrated embodiment, aperture 302*a* is sized to accept a pipe having a diameter of 1.25 inches, aperture 302*b* is sized to accept a pipe having a diameter of 1.75 inches, and aperture 302*c* is sized to accept a pipe having a diameter of 1.50 inches. The sizes are marked by numerals stamped in marking plate 300, numerals affixed by an adhesive, and the like. Other embodiments could have apertures sized to accept pipes of different sizes. According to at least one embodiment, marking plate 300 includes apertures sized to accept pipes having a diameter of 1 inch as a minimum and a pipe having a diameter of 6 inches on as a maximum. Other embodiments are envisioned where pipes of different sizes can be accepted at a corresponding aperture.

Each of apertures 302*a*-302*c* is defined by two sides of half-circle shape. Accordingly, when marking plate 300 is in its closed or retracted position, the two half-circle sides of each aperture 302*a*-302*c* are in contact with one another and are aligned to form a circle. In this case, each aperture 302*a*-302*c* can receive a pipe corresponding to the aperture's respective size at a 90 degree angle with respect to the surface of marking plate 300.

However, as marking plate 300 is adjusted to extend its effective length, the distance between the first half-circle side and the second half-circle side of each of apertures 302*a*-302*c* varies according to the adjusted length marking plate 300. As a result, a pipe received through any of apertures 302*a*-302*c* may be angled with respect to the surface of marking plate 300 when the pipe abuts the first half-circle end and the second half-circle end of the aperture through which it is received. As can be seen the angle a pipe forms with respect to the surface of marking plate 300 when it abuts first half-circle end and the second half-circle end of an aperture varies as the distance between the first half-circle end and the second half-circle end varies. As such, a user can manipulate the length of marking plate 300 to achieve a desired angle between the pipe and marking plate 300. Once the desired angle is achieved, as confirmed by using indicators 303, the user can score or otherwise mark the pipe to note the angle at which the pipe should be cut or bent. This, or course, greatly improves efficiency and repeatable accuracy in the field of pipe cutting and/or pipe bending.

According to one aspect, the length of marking plate 300 is adjusted incrementally to achieve specific angles thought to be most useful for pipes of a given diameter. Referring to FIG. 1B, this can be achieved by, e.g., sliding marking first plate 301*a* along the length of second plate 301*b*. According to this aspect, the distance between the first half-circle side and the second half-circle side of each aperture 302 is adjusted in increments corresponding to an angle of a pipe received through the marking plate with respect to the surface of the marking plate when the pipe is abutted against the first half-circle end and the second half-circle end of the aperture through which it is received.

Marking plate 300 is also marked by various indicators 303. Indicators 303 give a user notice of what angle(s) a pipe forms with respect to marking plate 300 when received at a respective aperture 302. Each indicator 303 can be, e.g., silkscreened, stamped, etched, or laser cut into the surface of marking plate 300.

According to an aspect, each indicator 303*a*-303*n* corresponds to a distance between a first half-circle end and a second-half circle of each of apertures 302*a*-302*c*. Further, each indicator specifies, at each corresponding distance, the diameter of a pipe received through a given aperture 302*a*-302*c*, as well as the angle formed by the pipe of the given diameter at that specific distance. This may be pinpointed by aligning arrowheads marked on each of pieces 301*a* and 301*b*, such that the distance of marking plate 300 dictates the specific angle marked by indicator 303.

In other words, indicators 303 signify the angle between adjustable marking plate 300 and the pipe when the pipe of the specified diameter abuts the first end and the second end of the corresponding aperture 302, at the corresponding distance between the first half-circle end and the second half-circle end of the corresponding aperture 302.

According to an embodiment where marking plate 300 comprises two pieces that are movable with respect to one another, e.g., marking first plate 301*a* and second plate 301*b*, a user may slide marking first plate 301*a* along the length of second plate 301*b* to align an arrow head comprising a given indicator 303 for a pipe of a corresponding diameter forming a corresponding angle. Doing so signifies to the user when a pipe of a certain size forms a certain angle with respect to marking plate 300. Once the angle is formed, marking means 304 can be used to mark the pipe about a line at which it should be cut.

Marking means 304 can be used to mark a pipe received through adjustable marking plate 300 about a line at which the pipe should be cut when the pipe abuts the first half-circle end and the second half-circle end of an aperture 302. According to one aspect, making means 304 comprises a chalk line extending from a first end of marking plate 300 to a second end of marking plate 300. According to another aspect, marking means 304 comprises a sharp edge extending between each end of marking plate 300 and sufficient to score the pipe extending from a first end of marking plate 300 to a second end of marking plate 300.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Therefore, the disclosure is not intended to be limited to the examples and designs described herein but is to be accorded the widest scope consistent with the principles and novel features disclosed herein.

Figure 4:
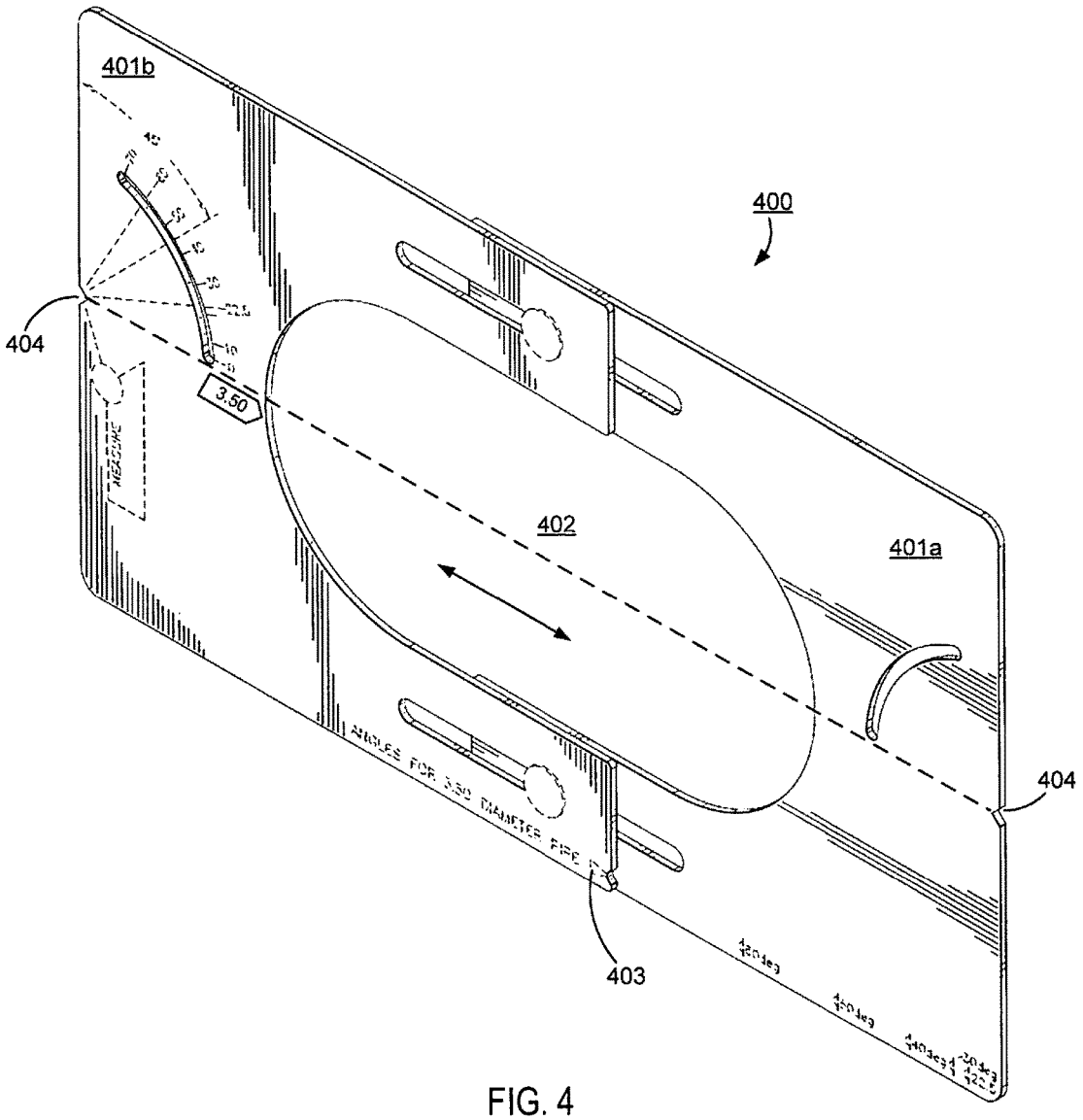
FIG. 4 illustrates aspects of a pipe etching system according to another embodiment.

FIG. 4 illustrates an embodiment of marking plate 400 having a single aperture, but otherwise corresponds to marking plate 100 illustrated FIG. 1, which has a plurality of apertures. Like the embodiment illustrated in FIG. 1, marking plate 400 is of adjustable length, as first plate 401*a* and second plate 401*b* can slide with respect to one another to adjust the effect length of marking plate 400. First plate 401*a* and second plate 401*b* can be secured or biased with respect to one another at a number of respective positions that provides different effective lengths for marking plate 400 by a number of mechanisms. According to one aspect, the length of marking plate 400 is fixed by locking the marking first plate 401*a* with respect to second plate 401*b*. Marking first plate 401*a* can be locked in place with respect to second plate 401*b* by, e.g., a clamping means, or the like. According to an embodiment, first plate 401*a* and second plate 401*b* can be secured to one another can be fixed with respect to one another by a fastening means, such as a bolt, that extends through respective apertures of first plate 401*a* and second plate 401*b* and a wing nut combination that is actuated along the length of the bolt until first plate 401*a* and second plate 401*b* are sufficiently biased against one another to hold them at a fixed position. Sliding first plate 401*a* along the length of second plate 401*b* changes the effective length of marking plate 400, as the effective length of aperture 402.

According to the embodiment illustrated in FIG. 4 aperture is configured to receive a pipe through marking plate 400. According to the illustrated embodiment, aperture 402 is sized to accept a pipe having a diameter of 3.5 inches. The size is marked by numerals stamped in marking plate 400, numerals affixed by an adhesive, and the like. Other embodiments could have apertures sized to accept pipes of different sizes. According to at least one embodiment, marking plate 400 includes an aperture sized to accept pipes having a diameter of 1 inch as a minimum and a pipe having a diameter of 6 inches on as a maximum. Other embodiments are envisioned where pipes of different sizes can be accepted at a corresponding aperture.

Aperture 402 is defined by two sides of half-circle shape. Accordingly, when marking plate 400 is in its closed or retracted position, the two half-circle sides of aperture 402 is in contact with one another and are aligned to form a circle. In this case, aperture 402 can receive a pipe corresponding to the aperture's respective size at a 90 degree angle with respect to the surface of marking plate 400.

However, as marking plate 400 is adjusted to extend its effective length, the distance between the first half-circle side and the second half-circle side of each of aperture 402—varies according to the adjusted length marking plate 400. As a result, a pipe received through any of aperture 402 may be angled with respect to the surface of marking plate 400 when the pipe abuts the first half-circle end and the second half-circle end of the aperture through which it is received. As can be seen the angle a pipe forms with respect to the surface of marking plate 400 when it abuts first half-circle end and the second half-circle end of an aperture varies as the distance between the first half-circle end and the second half-circle end varies. As such, a user can manipulate the length of marking plate 400 to achieve a desired angle between the pipe and marking plate 400. Once the desired angle is achieved, as confirmed by using indicator 403, the user can score or otherwise mark the pipe to note the angle at which the pipe should be cut or bent. This, or course, greatly improves efficiency and repeatable accuracy in the field of pipe cutting and/or pipe bending.

According to one aspect, the length of marking plate 400 is adjusted incrementally to achieve specific angles thought to be most useful for pipes of a given diameter. Marking plate 400 is also marked by various indicators 403. Indicator 403 gives a user notice of what angle(s) a pipe forms with respect to marking plate 400 when received at aperture 402. Each indicator 403 can be, e.g., silkscreened, stamped, etched, or laser cut into the surface of marking plate 400.

According to an aspect, indicator 403 corresponds to a distance between a first half-circle end and a second-half circle of each of aperture 402. Further, each indicator specifies, at each corresponding distance, the diameter of a pipe received through aperture 402, as well as the angle formed by the pipe of the given diameter at that specific distance. This may be pinpointed by aligning arrowheads marked on each of pieces 401*a* and 401*b*, such that the distance of marking plate 400 dictates the specific angle marked by indicator 403.

In other words, indicator 403 signifies the angle between adjustable marking plate 400 and the pipe when the pipe of the specified diameter abuts the first end and the second end of aperture 402, at the corresponding distance between the first half-circle end and the second half-circle end of aperture 402.

According to an embodiment where marking plate 400 comprises two pieces that are movable with respect to one another, e.g., marking first plate 401*a* and second plate 401*b*, a user may slide marking first plate 401*a* along the length of second plate 401*b* to align an arrow head comprising a given indicator 403 for a pipe of a corresponding diameter forming a corresponding angle. Doing so signifies to the user when a pipe of a certain size forms a certain angle with respect to marking plate 400. Once the angle is formed, marking means 404 can be used to mark the pipe about a line at which it should be cut.

Marking means 404 can be used to mark a pipe received through adjustable marking plate 400 about a line at which the pipe should be cut when the pipe abuts the first half-circle end and the second half-circle end of aperture 402. According to one aspect, making means 404 comprises a chalk line extending from a first end of marking plate 400 to a second end of marking plate 400. According to another aspect, marking means 404 comprises a sharp edge extending between each end of marking plate 400 and sufficient to score the pipe extending from a first end of marking plate 400 to a second end of marking plate 400.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Therefore, the disclosure is not intended to be limited to the examples and designs described herein but is to be accorded the widest scope consistent with the principles and novel features disclosed herein.

The invention claimed is:

1. An apparatus for marking pipes at a plurality of cutting angles, the apparatus comprising:

a marking plate of adjustable length comprising a plurality of apertures and a plurality indicators, where each of the plurality of apertures is of a size different from the size of each of the other of the plurality of apertures and is of a size to receive a pipe of a certain diameter through the adjustable marking plate, where each aperture is defined by a first half-circle side and a second half-circle side and the distance between the first half-circle side and the second half-circle side of each aperture varies according to the adjusted length of the marking plate, where the distance between the first half-circle side and the second half-circle side of each aperture is adjusted in increments corresponding to an angle of a pipe received through the marking plate with respect to the surface of the marking plate when the pipe is abutted against the first half-circle end and the second half-circle end of the aperture through which it is received, and where each of the plurality of indicators corresponds to a distance between a first half-circle end and a second-half circle end of the plurality of the apertures and specifies a diameter of a pipe received through the adjustable marking plate and the angle of the pipe with respect to the adjustable marking plate when the pipe of the specified diameter abuts the first end and the second end of the aperture at the corresponding distance between the first half-circle end and the second half-circle end of the aperture.

2. The apparatus of claim 1 further comprising a means for marking a pipe received through the adjustable marking plate about a line at which the pipe should be cut when the pipe abuts the first half-circle end and the second half-circle end of an aperture.

3. The apparatus of claim 2 where the means for marking comprises a chalk line extending from a first end of the marking plate of adjustable length to a second end of the marking plate of adjustable length.

4. The apparatus of claim 2 where the means for marking comprises a sharp edge sufficient to score the pipe extending from a first end of the marking plate of adjustable length to a second end of the marking plate of adjustable length.

5. The apparatus of claim 1 where the marking plate comprises two marking plate pieces and the length of the marking plate is adjusted by sliding a first piece of the marking plate of adjustable length along the length of a second piece of the marking plate of adjustable length.

6. The apparatus of claim 5 where the length of the marking plate is fixed by locking the first piece with respect to the second piece.

7. The apparatus of claim 1 where one of the plurality of apertures is of a 1 inch diameter size.

8. The apparatus of claim 1 where one of the plurality of apertures is of a 1.25 inch diameter size.

9. The apparatus of claim 1 where one of the plurality of apertures is of a 1.5 inch diameter size.

10. The apparatus of claim 1 where one of the plurality of apertures is of a 1.75 inch diameter size.

11. The apparatus of claim 1 where one of the plurality of apertures is of a 2 inch diameter size.

12. An apparatus for marking pipes at a plurality of cutting angles, the apparatus comprising:

a marking plate comprising a plurality of apertures and a plurality indicators, where each of the plurality of apertures is of a same width and of a different length, where each of the plurality of apertures is of a size to receive a pipe of a specified diameter, where each aperture is defined by a first half-circle side and a second half-circle side and the distance between the first half-circle side and the second half-circle side of each aperture varies between each of the plurality of apertures, where the distance between the first half-circle side and the second half-circle side of each aperture corresponds to an angle of the pipe of specified diameter received through the marking plate with respect to the surface of the marking plate when the pipe is abutted against the first half-circle end and the second half-circle end of the aperture through which it is received, and where each of the plurality of indicators corresponds to an angle between the pipe of a specified diameter and the marking plate when the pipe of the specified diameter abuts the first end and the second end of the aperture.

13. The apparatus of claim 12 further comprising a means for marking a pipe received through the adjustable marking plate about a line at which the pipe should be cut when the pipe abuts the first half-circle end and the second half-circle end of an aperture.

14. The apparatus of claim 13 where the means for marking comprises a chalk line extending from a first end of the marking plate of adjustable length to a second end of the marking plate of adjustable length.

15. The apparatus of claim 13 where the means for marking comprises a sharp edge sufficient to score the pipe extending from a first end of the marking plate of adjustable length to a second end of the marking plate of adjustable length.

16. The apparatus of claim 12 where one of the plurality of apertures is of a 1 inch diameter size.

17. The apparatus of claim 12 where one of the plurality of apertures is of a 1.25 inch diameter size.

18. The apparatus of claim 12 where one of the plurality of apertures is of a 1.5 inch diameter size.

19. The apparatus of claim 12 where one of the plurality of apertures is of a 1.75 inch diameter size.

20. The apparatus of claim 12 where one of the plurality of apertures is of a 2 inch diameter size.

* * * * *